United States Patent [19]

Fisher

[11] Patent Number: 4,513,772

[45] Date of Patent: Apr. 30, 1985

[54] AUTOMATIC HOSE REEL

[76] Inventor: Richard Fisher, 300 S. Val Vista #44, Mesa, Ariz. 85024

[21] Appl. No.: 516,518

[22] Filed: Jul. 25, 1983

[51] Int. Cl.[3] ..... B65H 75/34

[52] U.S. Cl. ..... 137/355.22; 137/355.26; 188/82.7; 192/114 R; 242/86.2

[58] Field of Search ..... 137/355.2, 355.22, 355.26; 242/86, 86.2; 192/114 R, 43.1; 188/82.7, 82.77; 74/577 M

[56] References Cited

U.S. PATENT DOCUMENTS

| | | | |
|---|---|---|---|
| 184,956 | 12/1876 | Delaney | 137/355.2 |
| 2,301,208 | 11/1942 | Gear | 242/86 |
| 2,509,476 | 5/1950 | Brown | 242/86.2 |
| 2,573,868 | 11/1951 | Newell | 137/355.21 |
| 2,590,963 | 4/1952 | Hannay | 242/86.2 |
| 2,606,067 | 8/1952 | Roark | 137/355.2 |
| 3,232,555 | 2/1966 | Gorrell et al. | 242/86.5 A |
| 3,394,730 | 7/1968 | Sherman | 137/355.22 |
| 3,539,045 | 11/1970 | Sinclair | 192/114 R |
| 3,590,656 | 7/1971 | Lloyd, Jr. | 188/82.7 |

*Primary Examiner*—Martin P. Schwadron
*Assistant Examiner*—Sheri Novack
*Attorney, Agent, or Firm*—Don J. Flickinger

[57] ABSTRACT

An automatic hose winding apparatus includes a reel rotatably coupled between first and second side members of a frame. A clutch is coupled between a motor and the reel for selectively imparting rotary motion thereto. A guide assembly including a traversing screw, a follower mounted on the traversing screw, and a guide bar, guide the hose onto the reel. A lever assembly coupled to the frame and responsive to rotation of the guide bar disengages the clutch just prior to turning the motor off.

17 Claims, 11 Drawing Figures

FIG. 1
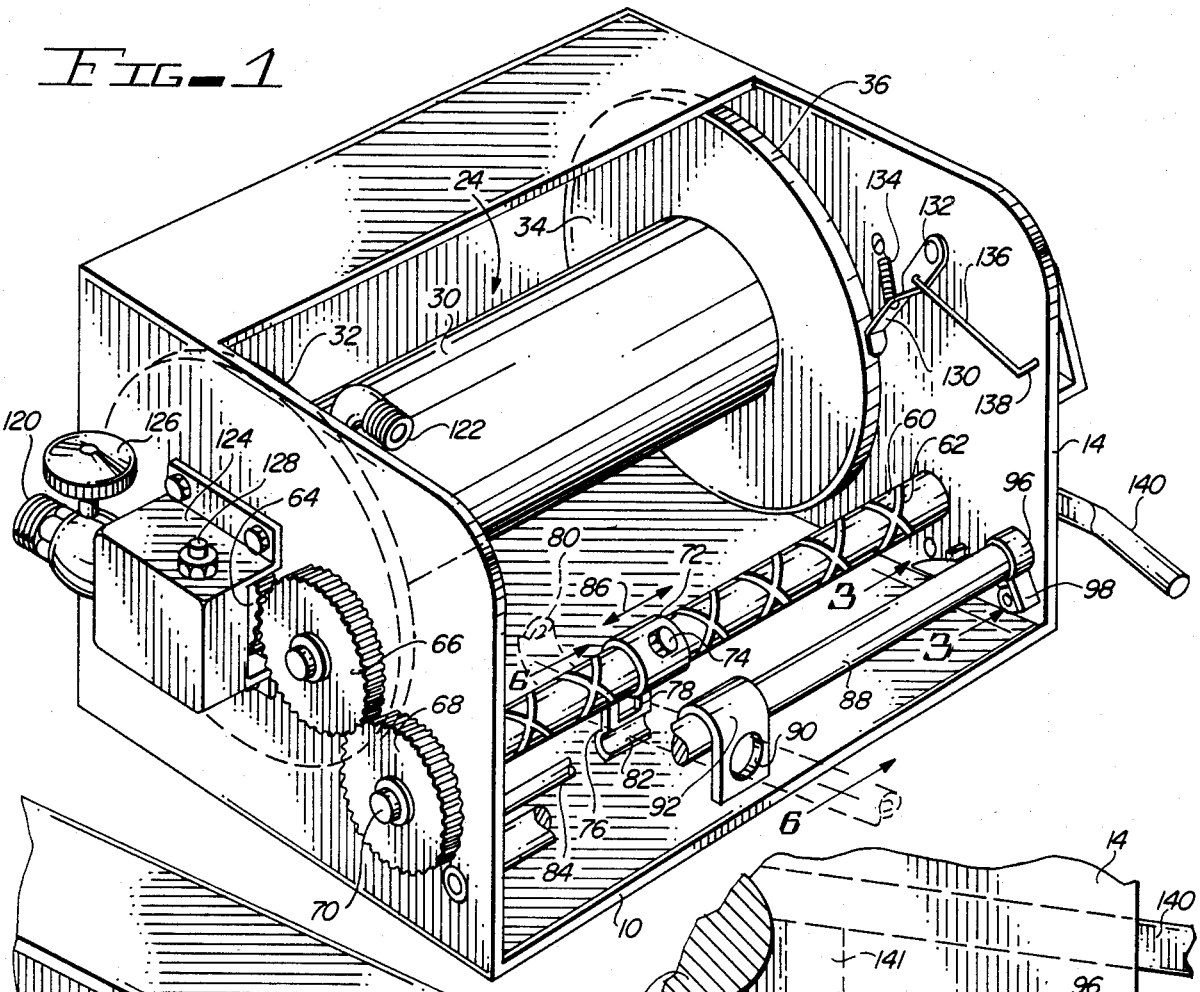
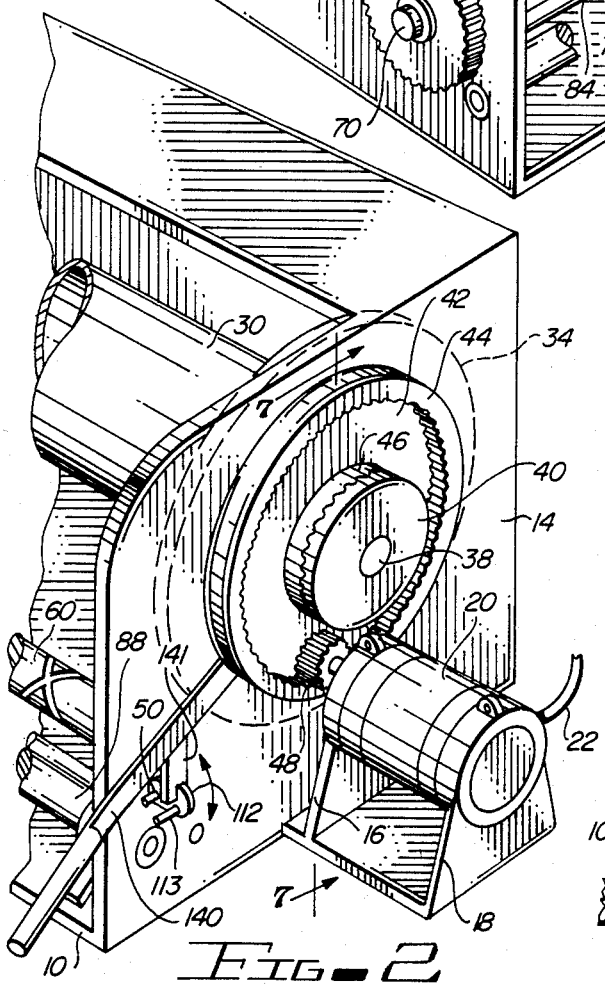
FIG. 2
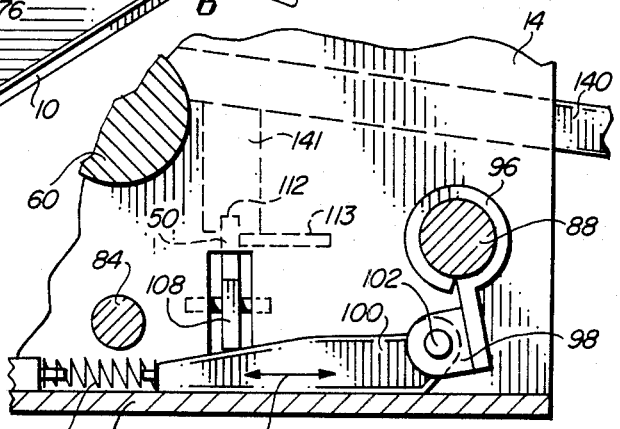
FIG. 3A
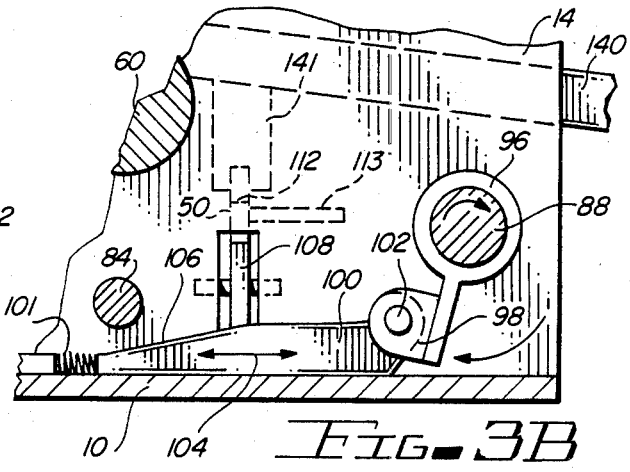
FIG. 3B

AUTOMATIC HOSE REEL

BACKGROUND OF THE INVENTION

1. Field of the Invention

This invention relates generally to automatic hose retrieval apparatus and, more particularly, to such apparatus which includes a motor driven reel assembly, a clutch mechanism, and means for substantially simultaneously disengaging the clutch and activating a switch to turn off the motor.

2. Prior Art

In the past, it was common to retrieve hoses and the like by manually winding them around a suitable structure such as a reel or simply winding them into loose coils. Unfortunately, when hose is paid out from such manually wound forms, it often times becomes snarled or tangled requiring appreciable time and effort to correct the situation.

In an effort to solve these problems, hose retrieval devices have been developed which automatically retrieve and wind hose on a reel in such a manner so as to avoid tangling next time the hose is deployed or paid out. Such devices generally include a reel and a level wind mechanism for guiding the hose onto the reel. The level wind mechanism includes a traversing screw, a guide rod, and a follower. The reel is driven by a motor and clutch assembly. Unfortunately, suitable means have not been provided for simultaneously disengaging said clutch assembly and interrupting power to said motor when the hose has been fully retrieved.

Therefore, it is an object of the present invention to provide an improved hose winding apparatus.

It is a further object of the present invention to provide an improved hose winding apparatus which is constructed so as to provide for manual and automatic operation.

It is still a further object of the present invention to provide an improved hose winding apparatus including a reel which is motor driven via a clutch assembly and which includes means for automatically disengaging the clutch assembly and interrupting power to the motor.

Yet another object of the present invention is to provide an improved hose winding apparatus which is durable in construction, and efficient and reliable in operation.

Yet a still further object of the present invention is to provide an improved automatic hose winding apparatus which includes means for draining the hose.

Still another object of the present invention is to provide an automatic hose winding apparatus which includes an improved anti-backlash mechanism.

SUMMARY OF THE INVENTION

According to a broad aspect of the invention, there is provided an apparatus for automatically winding a hose comprising a frame having first and second side members, reel means rotatably and transversely coupled between the first and second side members for receivings the hose, a motor coupled on the frame, clutch means coupled between the motor and the reel means for selectively imparting rotary motion from the motor to the reel means, guide means coupled between the first and second side members for guiding hose to said reel means, and first means coupled to said guide means and responsive thereto for simultaneously turning off the motor and disengaging the clutch.

BRIEF DESCRIPTION OF THE DRAWINGS

The above and other objects, features and advantages of the present invention will be better understood from the following detailed description taken in conjunction with the accompanying drawings, in which:

FIG. 1 is a perspective view of the invention hose winding apparatus;

FIG. 2 is an isometric view of a portion of the inventive hose winding apparatus not shown in FIG. 1 and including a drive motor and clutch actuation assembly;

FIGS. 3A and 3B are partial cross-sectional views taken along the line 3—3 in FIG. 1 and illustrates in more detail the clutch actuation assembly;

DESCRIPTION OF THE PREFERRED EMBODIMENT

Figure 4A:
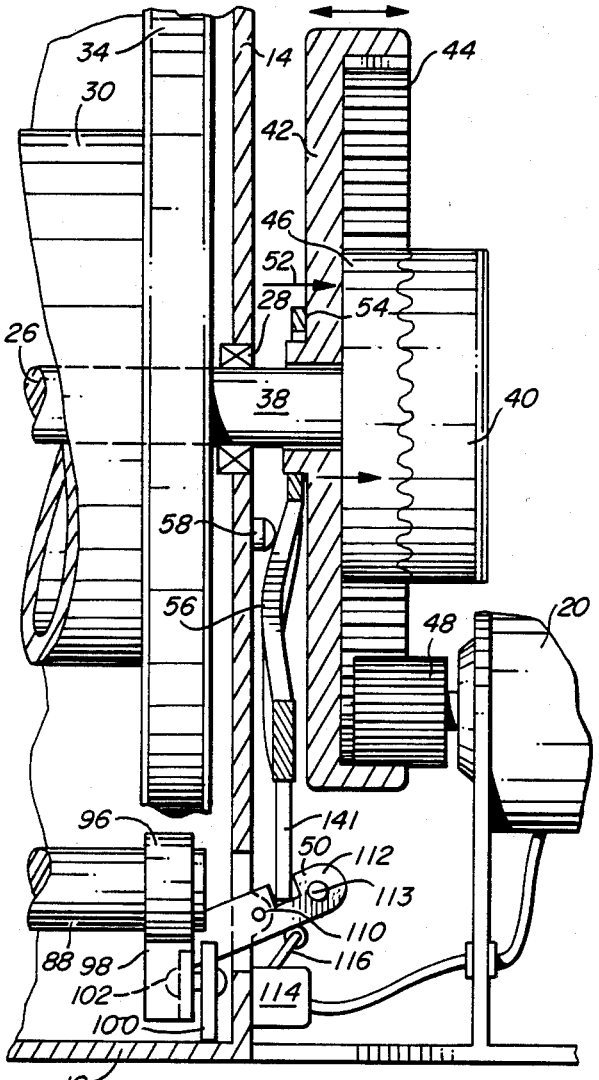
FIGS. 4A and 4B and illustrate further details of the drive and clutch assemblies with the clutch engaged and non-engaged, respectively.

FIGS. 1, 2, 3A, 3B, 4A, 4B, 5A, and 5B illustrate, in detail, the inventive hose winding apparatus. Throughout the several views, like elements are denoted with like reference numerals.

Referring to the drawings, and more particularly to FIGS. 1 and 2, a frame 10 includes first and second spaced apart, parallel and upstanding side members 12 and 14, respectively. Frame 10 and side members 12 and 14 may be fabricated of sheet steel or any other material which provides the required strength and rigidity. To the right of side member 14 are first and second flanges 16 and 18, respectively, to which an electric motor 20 is secured by means of bolts or the like. Motor 20 receives its power via power line 22 which is coupled to a source of electrical energy (not shown).

Figure 4B:
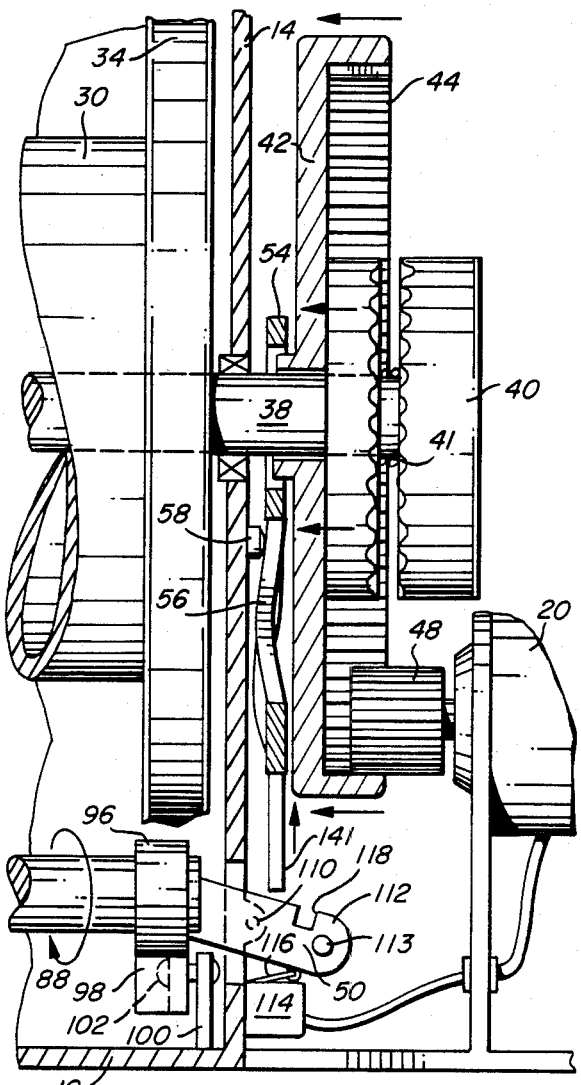

A reel 24, supported by a shaft 26, is journaled for rotation in bearing sockets 28 located in side members 12 and 14 (see FIGS. 4A and 4B). Reel 24 includes cylindrical portion 30 and first and second end portions 32 and 34, respectively. As can be seen, the peripheral edge 16 of end portion 34 is notched for reasons to be described herein below.

Shaft 26 includes an end portion 38 upon which is fixedly coupled a gear 40. A flywheel 42, including an outer gear 44 and an inner gear 46, is rotatably and slidably mounted on end section 38. Outer gear 44 is engaged with gear 48 which is fixed to the end of motor shaft such that when the motor is running, gear 48 will impart rotary motion on flywheel 42.

Referring temporarily to FIGS. 4A and 4B, the clutch mechanism is shown which, when acted upon by lever 50 in a manner to be described below, will cause flywheel 42 to move in the direction indicated by arrow 52 resulting in the engagement of gears 40 and 46. In this condition, rotation of flywheel 42 by motor 20 via gear 48 will result in rotation of gear 40 and therefore reel 24. This condition is shown in FIG. 4A. The clutch mechanism includes a clutch fork 54 which is equipped with a curved section 56 curved so as to exit the space between sidewall 14 and flywheel 42 approximately midway there between. A projection 58 is provided on side member 14 which engages section 56 and acts as a pivot point therefor. Lever arm 140 is coupled to section 56 and may be moved right or left. When lever arm 140 is moved to the left, section 56 pivots about projection 58 and flywheel 42 will move in the direction of arrow 52. Flywheel 46 is biased away from gear 40 by compression spring 41 (as is shown in FIG. 4B). Therefore flywheel 42 will be pushed away from gear 40 when lever 50 is moved to the right.

Curved section 56 may be constructed of steel or any other material which provides the required strength and rigidity.

Referring again to FIGS. 1 and 2, an externally threaded traversing screw 60, having threads 62 thereon, is journaled for rotation between side members 12 and 14 and is substantially parallel to cylindrical portion 30 of reel 24. Traversing screw 60 is caused to rotate when reel 24 rotates through the action of gears 64, 66 and 68. That is, when reel 24 is rotated by motor 20, gear 64, which is fixedly coupled to a second end section of shaft 26 (not shown), also rotates. This causes rotation of a second gear 66 which is rotatably coupled on side member 12 which in turn causes rotation of gear 68 which is fixedly coupled to an extension 70 of traversing screw 60.

Positioned on traversing screw 60 is a follower 72 having a set screw 74 therethrough, the inner end of which engages threads 62. A lower portion 76, of follower 72, has an aperture 78 therethrough through which hose 80 passes. Lower portion 76 of follower 72 is also provided with an anti-rotation sleeve 82 which engages bar 84 coupled between side members 12 and 14. Thus, as traversing screw 60 is rotated by gear 68, follower 72, which is slidably mounted on traversing screw 60, will slide back and forth as is indicated by arrow 86 causing the hose to be evenly wound on reel 24.

Also journaled for rotation within side members 12 and 14 is a guide bar 88 having a guide memeber 92 slidably mounted thereon. Guide member 92 is equipped with a projecting portion having an aperture 90 therethrough of sufficient diameter to permit hose 80 to pass therethrough but of insufficient diameter to permit passage of the end couplers (FIG. 5B) normally attached to the ends of conventional hoses.

While guide member 92 may freely slide along guide bar 88, it is keyed (such as is shown at 94 in FIGS. 5A and 5B) such that rotation of guide member 92 will cause a similar rotation of guide bar 88.

Fixedly coupled to an end of guide bar 88 is a sleeve 96 having a projection 98 fixedly coupled thereto. A slide member 100 is pivotably coupled at 102 to projection 98 and is capable of translational movement in the directions of arrow 104 (see FIGS. 3A and 3B). Slide member 100 rests on frame 10 and is provided with an inclined surface 106. Movement of slide member 100 to the left is resisted by compression spring 101. That is, unless the end of the hose has been reached, spring 101 will urge slide member 100 to the right. A similar biasing could be achieved by means of a torsion spring mounted on guide bar 88 in the well known manner.

Lever arm 50 is pivotably coupled to side member 14 at 110 and has a first end 108 which is raised and lowered by inclined surface 106 as slide member 100 slides back and forth. (See FIGS. 3A and 3B.) This causes the opposite end 112 of lever arm 50 to alternately rise and fall. Additionally, end 112 of lever arm 50 turns on and off a microswitch 114 (shown in FIGS. 4A and 4B) which, when off, interrupts power to motor 20.

The automatic hose winding apparatus described thus far operates as follows. By urging lever arm 140 to the left and engaging the clutch mechanism as previously described, projecting arm 141 is brought into alignment with notch 118. End 112 of lever arm engagement with notch 118 thereby maintaining the clutch mechanism engages. This situation is shown in FIG. 4A.

Figure 5A:
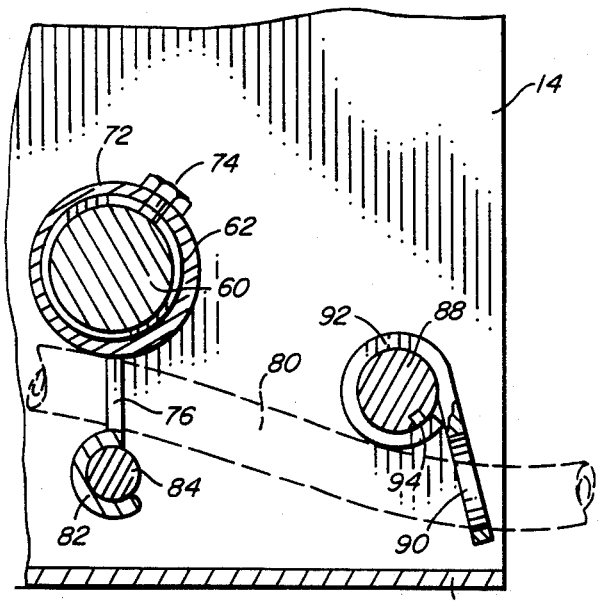
FIGS. 5A and 5B are cross-sectional views illustrating how the guide bar is rotated when the hose is fully reeled in to disengage the clutch and stop the motor.

As hose is being wound onto reel 24, guide member 92 maintains a position shown in FIG. 5A. Thus, guide bar 88 will not be rotated and end 108 of lever arm 50 will reside on a lower portion of inclined surface 106 of slide member 100 as is shown in FIG. 3A. As a result, flywheel 42 will remain engaged with gear 40. Thus, with the flywheel engaged, wheel 24 will continue to rotate thus causing transversing screw 60 to also rotate.

Figure 5B:
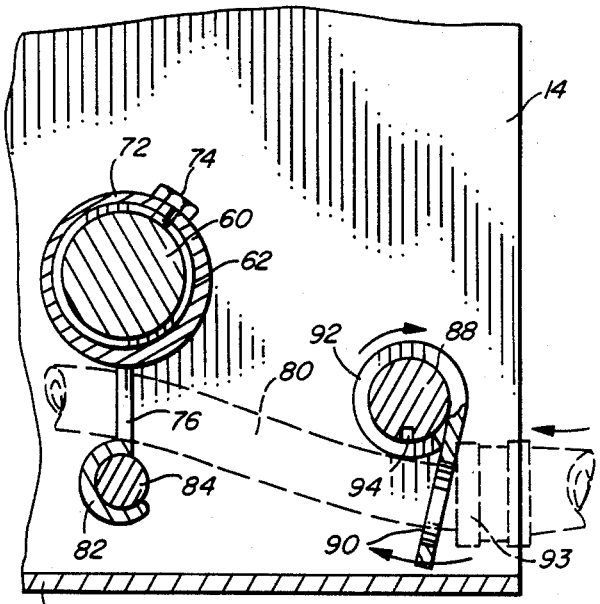

When coupler 93 of hose 80 bears against guide member 92 causing it to rotate as is shown in FIG. 5B, slide member 100 is forced to the left as is shown in FIG. 3B. As end 108 of lever arm 50 is lifted along inclined surface 106, the opposite end 112 of lever arm 50 will fall and disengage notch 118. Flywheel 42 will move to the left under the force of spring 41 and disengage gear 40. This situation is shown in FIG. 4B.

As guide member 92 continues to rotate, slide member 100 is forced further to the left causing end 108 of lever arm 50 to rise still further on inclined surface 106. This causes end 112 to fall still further and engage arm 116 of switch 114 (e.g. a microswitch) interrupting power to motor 20 thus turning it off. In other words, the clutch mechanism is disengaged just prior to substantially simultaneous with interrupting power to the motor. This situation is shown in FIG. 4B.

Referring again to FIGS. 1 and 2, the inventive hose winding apparatus includes an input 120 for receiving liquid from a source and an output 122 which may be connected to an end of hose 80 for providing liquid thereto. Inlet 120 and outlet 122 may be coupled by a seal ring mechanism contained within housing 124 and of the type well known to those skilled in the art. A shut-off valve 126 is provided to stop the flow of water without requiring that input 120 be disconnected from the source. In addition, an air bleed mechanism 128, of the type known to those skilled in the art, is provided to permit drainage of hose 80 when valve 126 is turned off.

In order to prevent undesired unwinding of hose 80 from reel 24, an anti-backlash mechanism, including lever 140 mounted to side member 14 at 132 and biased by spring 134 is provided to engage the notches on the peripheral edge 36 of end member 34. If unwinding is desired, a linkage 136 coupled to lever 130 and having a right angle termination 138 will be hooked over the edge of side member 14 thus pulling lever 130 back and away from the notches. Should linkage 136 be released from side member 14, the lever will automatically engage the notches due to the biasing by spring 135 which is coupled to lever 130 and to side member 14.

Figure 6A:
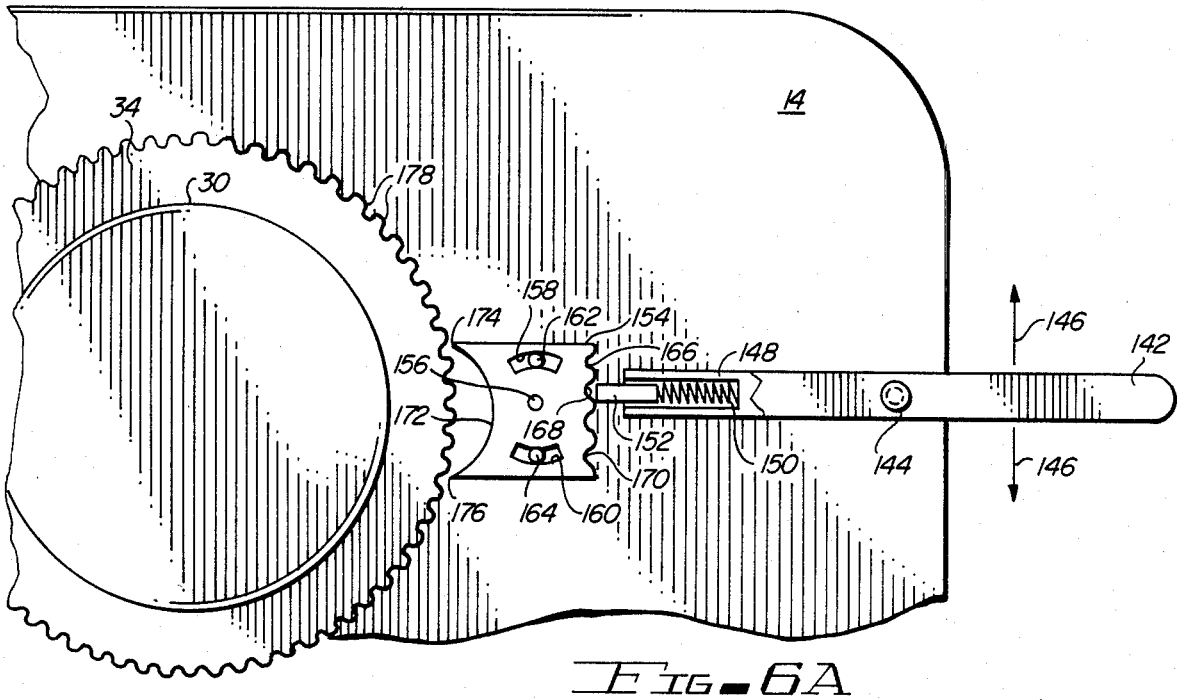
FIGS. 6A, 6B and 6C illustrate an improved anti-backlash mechanism for use in conjunction with a hose winding apparatus.
Figure 6B:
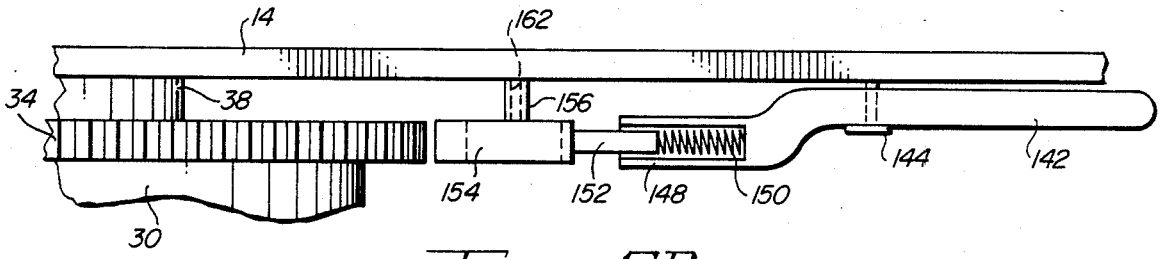
Figure 6C:
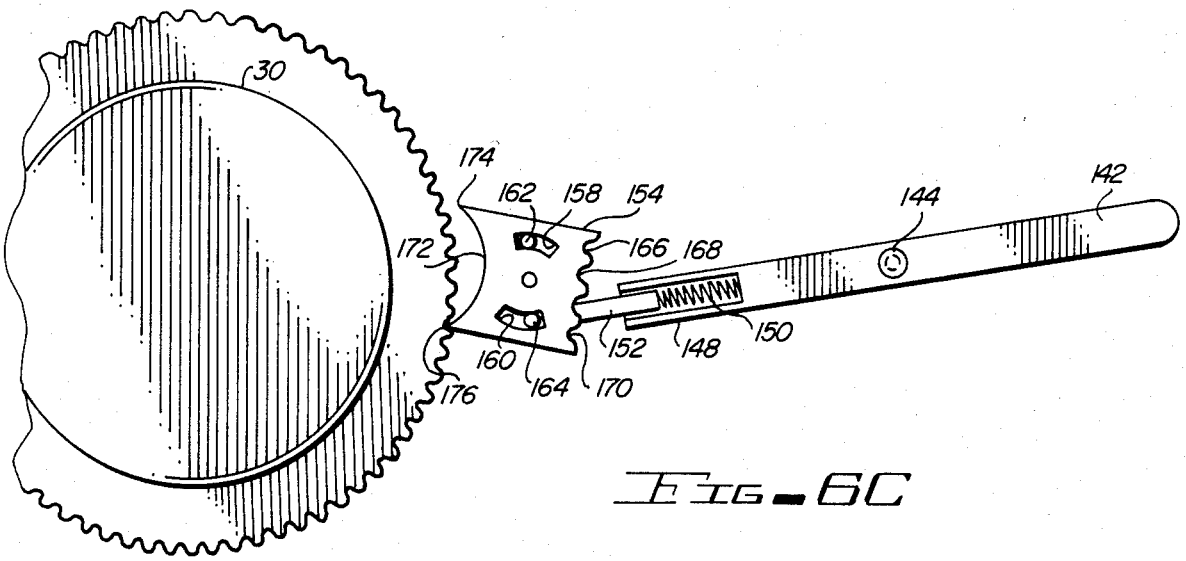

FIGS. 6A, 6B and 6C illustrate a second anti-backlash mechanism. A control arm 142 is pivotably coupled to side 14 by pin 144 and is capable of being moved in the directions of arrows 146. Control arm 142 has a hollow end 148 which houses a spring 150 and a spring loaded plunger 152 capable of longitudinal movement within hollow end 148.

A head 154 is pivotably coupled to side 14 at 156 and is provided with first and second arcuate slots 158 and 160. Pins 162 and 164 are fixedly coupled to side 14 and extend into slots 158 and 160, respectively.

The right side of head 154 is provided with upper, lower and middle concavities 166, 168 and 170 respectively each of which may receive the outer end of plunger 152. The left side of head 154 is equipped with a single concavity 172 forming upper and lower pointed sections 174 and 176 respectively.

If, for example the right end of control arm 142 is moved upward, plunger 152 will engage lower concavity 170 and cause head 154 to rotate clockwise. Thus, pointed section 176 will engage a recess between adjacent teeth 178 on the periphery of end section 34 and pin 164 will abut against the right-most end of slot 160. This situation is shown in FIG. 6C. In this mode, reel 24 may rotate clockwise since each tooth 178 will cause head 154 to rotate counter-clockwise and depress plunger 152. In contrast, reel 24 cannot rotate counter-clockwise since each tooth 178 would attempt to rotate head 154 clockwise. Such rotation is prevented, however, since pin 164 is already abutting the right end of slot 160.

Similarly, if the right end of control arm 142 is moved downward, plunger 152 will cause head 154 to rotate counter-clockwise, and pointed section 174 of head 154 will engage teeth 178. Since pin 162 will abut against the right end of slot 158 counter-clockwise rotation of reel 24 will be possible; however, clockwise rotation will be prevented.

Finally, a lever arm 140 is provide to permit manual control of the clutch mechanism and therefore the entire hose winding apparatus.

The above description is given by way of example only. Changes in form and details may be made by one skilled in the art without departing from the scope of the invention as defined by the appended claims.

I claim:

1. An apparatus for automatically winding a hose of the type which includes end couplers, said apparatus comprising:

a frame having first and second side members;

reel means rotatably and transversely coupled between said first and second side members for receiving said hose;

a motor coupled on said frame;

electrical switch means for coupling said motor to a source of power when in a first state, and for disconnecting said motor for said source of power when in a second state;

clutch means coupled between said motor and said reel means for selectively and imparting rotary motion from said motor to said reel means;

guide means coupled between said first and second side members for guiding hose to said reel means; and first means coupled to said guide means and responsive thereto for substantially simultaneously disengaging said clutch and turning off said motor;

said guide means comprising an elongated externally threaded traversing screw journaled for rotation in said first and second side members and positioned substantially parallel to said reel means, second means coupled between said reel means and said traversing screw for rotating said traversing screw in response to rotation of said reel means, follower means mounted on said traversing screw and movable thereof on opposite directions during rotation of said traversing screw, and a guide assembly journaled for rotation in said first and second side members and positioned substantially parallel to said traversing screw for guiding hose to said follower means;

said guide assembly comprising:

a guide bar journaled for rotation in said first and second side members, and a yoke transversely slideable on said guide bar but rotatably fixed with respect thereto and having a transverse aperture therein of an inner diameter just sufficient to permit passage therethrough of said hose and insufficient to permit passage of said end couplers, said guide bar being caused to pivot when said yoke is engaged by one of said end couplers;

said first means comprising a projecting member fixedly coupled on said guide bar and pivotable therewith, a slide member hingedly coupled to said projecting member so as to move translationaly when said projecting member pivots, and a lever arm pivotably coupled in said frame and capable of assuming first, second and third positions in response to movement of said slide member, said first position for maintaining said electrical switch means in said first state and for maintaining engagement of said clutch means, said second position for disengaging said clutch means, and said third position for placing said electrical switch means in said second state.

2. An apparatus according to claim 1 wherein said slide member has an inclined surface which engages a first end of said lever arm so as to cause said first end to change position in response to translational movement of said slide member.

3. An apparatus according to claim 2 wherein said electrical switch means is a microswitch coupled on said frame proximate a second end of said lever arm.

4. An apparatus according to claim 2 wherein said reel means comprises:

a reel;

a pair of longitudinally extening shaft sections journaled for rotation in said first and second side members and extending therethrough; and a first gear fixedly coupled to the end of a first one of said pair of shaft sections.

5. An apparatus according to claim 4 wherein said clutch means comprises:

a flywheel rotatably and slideably mounted on said first one of said pair of shaft sections, said flywheel including first gear means for engaging said motor and drive gear means for engaging said first gear; and third means coupled to said flywheel and responsive to said lever arm for maintaining said flywheel coupled to said motor and said first gear when said lever arm is in said first position and for disengaging said flywheel from said motor and said first gear when said lever arm is in the said second position.

6. An apparatus according to claim 5 a lever for manually engaging and disengaging said clutch means.

7. An apparatus according to claim 6 wherein said third means comprises a clutch fork coupled to said flywheel and to said lever and capable of moving said flywheel between an engaged and non-engaged position in response to movement of said lever;

an extension fixedly coupled to said lever for engaging said lever arm when said lever arm is in said first position so as to maintain said flywheel coupled to said motor.

8. An apparatus according to claim 7 further comprising a spring coupled on said shaft between said flywheel and said first gear to maintain the two normally apart.

9. An apparatus according to claim 8 wherein said second means comprises a gear assembly.

10. An apparatus according to claim 7 wherein said follower means comprises:

a sleeve slidably mounted on said traversing screw;

fourth means coupled to said sleeve for engaging the threads on said traversing screw;

fifth means coupled to said sleeve for preventing rotation of said sleeve; and sixth means for guiding said hose onto said reel.

11. An apparatus according to claim 10 wherein said fourth means is a set screw extending through said sleeve.

12. An apparatus according to claim 6 further comprising latching means coupled to said frame for engaging said reel to prevent rotation thereof in a desired direction.

13. An apparatus according to claim 6 further comprising coupling means for connecting another one of said couplers to a source of liquid.

14. An apparatus according to claim 13 wherein said coupling means includes valve means for interrupting the flow of liquid through said coupling means.

15. An apparatus according to claim 14 wherein said coupling means includes an air bleed mechanism for permitting said hose to drain.

16. An apparatus according to claim 13 wherein said coupling means comprises:

an input coupled to said frame;

an output coupled to said reel; and a seal ring mechanism coupled between said input and said output.

17. An apparatus according to claim 12 wherein said latching means selectively permits rotation of said reel means in desired directions.

* * * * *